US005430244A

United States Patent [19]

Ruffcorn et al.

[11] Patent Number: 5,430,244

[45] Date of Patent: Jul. 4, 1995

[54] DYNAMIC CORRECTION OF MUSICAL INSTRUMENT INPUT DATA STREAM

[75] Inventors: Donald Ruffcorn, Los Gatos; Robert C. Bliss, Soquel; Scott Wedge, Santa Cruz, all of Calif.

[73] Assignee: E-mu Systems, Inc., Scotts Valley, Calif.

[21] Appl. No.: 70,119

[22] Filed: Jun. 1, 1993

[51] Int. Cl.[6] ..... G10H 1/38

[52] U.S. Cl. ..... 84/669; 84/DIG. 22

[58] Field of Search ..... 84/609–614, 84/645, 634–638, 649–652, 666–669, DIG. 22

[56] References Cited

U.S. PATENT DOCUMENTS 5,281,754 1/1994 Farrett et al. ..... 84/645 X

*Primary Examiner*—Stanley J. Witkowski

*Attorney, Agent, or Firm*—Heller, Ehrman, White & McAuliffe

[57] ABSTRACT

Dynamic correction of a musical instrument input data stream providing a transposed musical context in conjunction with local scale and harmony corrections. Local corrections are applied with respect to a reference sequence and the time delay of local corrections may be varied by the user.

7 Claims, 3 Drawing Sheets

DYNAMIC CORRECTION OF MUSICAL INSTRUMENT INPUT DATA STREAM

BACKGROUND OF THE INVENTION

The present invention relates to a musical instrument such as an electronic musical keyboard instrument. In particular, the present invention is directed toward the dynamic correction of a musical instrument input data stream to provide transposed musical context in conjunction with local scale and harmony corrections, which are applied based on a variable time delay.

Professional musicians regularly transpose music to different keys while performing, using known transposing instruments such as pianos, organs and MIDI devices. Transposing allows a user to play from one learned scale and sound like all 12 scales, rather than learning all 12 scales.

Current musical context (e.g., the current measure) includes a scale and a harmony of related notes that provide pleasing sounds (subjectively) to listeners. There are some devices that pitch correct a user input tone to a current melody tone.

A continuously changing musical context dictates a type of correction to be applied. The user selects a class of correction (e.g., jazz, chorale, major/minor...) and the appropriate class member is chosen per note for correction (e.g., jazz, $Dm^9$, chorale D octave, Dm triad). A device known as a Hotz Box has dynamic chord setup, but not correction.

It would be desirable to allow a user to select an amount of time after which input notes will be corrected. There are known devices which correct immediately by not letting an incorrect note through (e.g., have zero time delay before correction).

SUMMARY OF THE INVENTION

It is an object of the present invention to provide an improved musical instrument.

It is another object of the present invention to provide a musical instrument playable by amateurs and professionals but yet sounds as if it is being professionally played.

The present invention provides an easy to play transposed and note corrected musical instrument with variable time delay. With a long time delay, no note correction occurs; with zero time delay only the corrected notes are played; with a small delay, wrong notes sound as "grace" notes. A selectable style of user specification of style allows all types of music to be played. Transposition allows one set of notes to be learned and played by the user. Dynamic note correction allows the user to just play notes and provide pleasing sounds without manually re-selecting new chord and scale patterns.

Other objects, features and advantages of the present invention will become apparent from the following detailed description when taken in conjunction with the accompanying drawings.

BRIEF DESCRIPTION OF THE DRAWINGS

The accompanying drawings, which are incorporated in and form a part of this specification, illustrate embodiments of the invention and, together with the following description, serve to explain the principles of the invention.

DETAILED DESCRIPTION OF THE PREFERRED EMBODIMENTS

Reference will now be made in detail to the preferred embodiments of the invention, examples of which are illustrated in the accompanying drawings. While the present invention will be described in conjunction with the preferred embodiments, it will be understood that they are not intended to limit the present invention to those embodiments. On the contrary, the present invention is intended to cover alternatives, modifications and equivalents, which may be included within the spirit and scope of the invention as defined by the appended claims.

Figure 1:
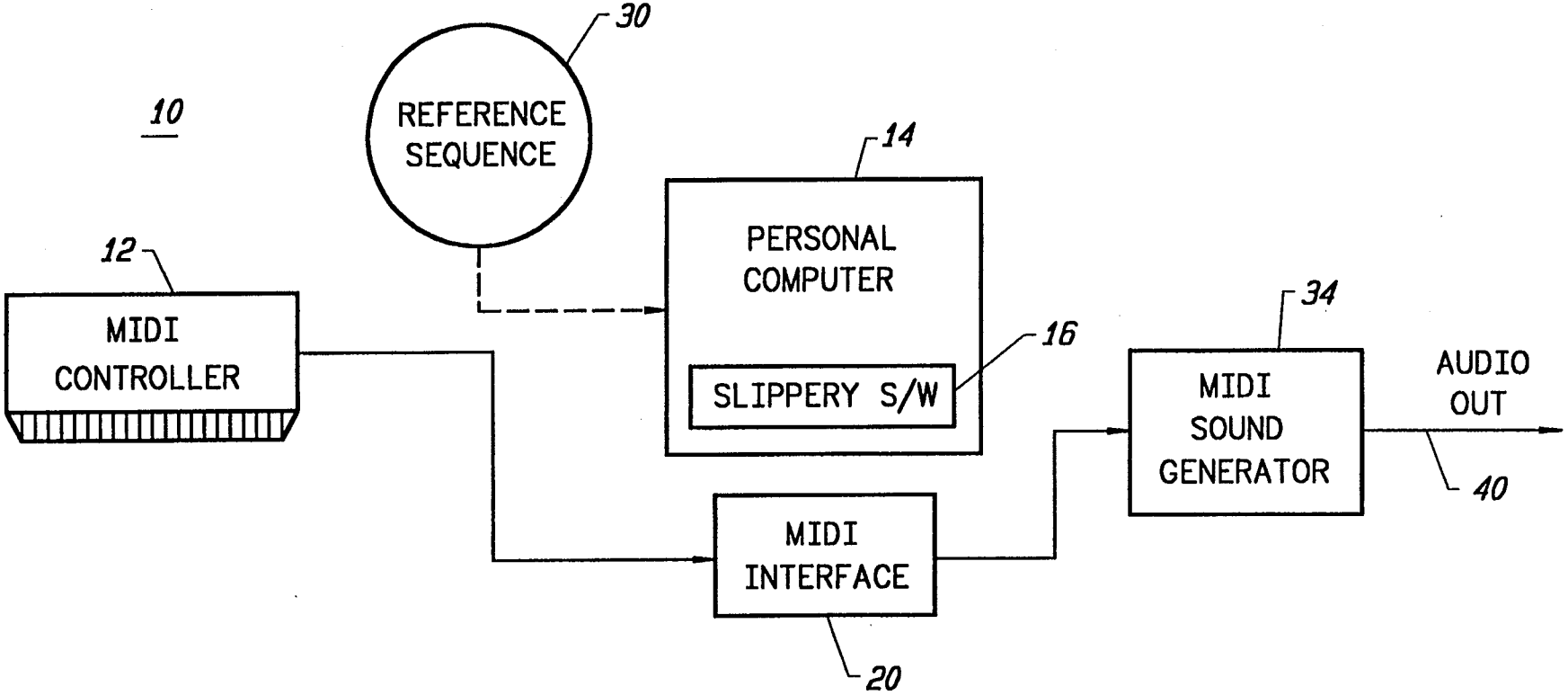
FIG. 1 depicts a block diagram of a musical instrument providing dynamic correction of an input data stream according to the present invention.

Referring now to FIG. 1, a block diagram of a musical instrument 10 utilizing dynamic correction of an input data stream is depicted. The present invention provides dynamic correction of a musical instrument input data stream. This enables transposed musical context in conjunction with local scale and harmony corrections, which are applied based upon a variable time delay.

In FIG. 1, the instrument 10 includes, in one preferred embodiment, a midi controller 12 which generates musical sound events such as by the pressing of one or more keys on a keyboard. For purposes of explanation, assume that a user depresses a key for middle C on midi controller 12. The output of midi controller is input to midi interface 20 which also receives inputs from a suitable control device such as personal computer 14.

Personal computer 14 also receives a reference sequence 30, which in one embodiment could be reference sequence data representative of background music used as a reference for harmonic context. The reference sequence 30 could come from an external generator, another external midi sequencer, or from a real time midi controller.

Personal computer 14 includes a software component 16 which for purposes of description will be described as "slippery" software. Software component 16 controls the dynamic correction of the reference sequence 30 and the input from midi controller 12. Midi interface 20 provides the dynamic correction as an input to midi sound generator 34. The output of midi sound generator 34 is the audio out 40 which includes the dynamic correction of the musical instrument input data stream.

Figure 2:
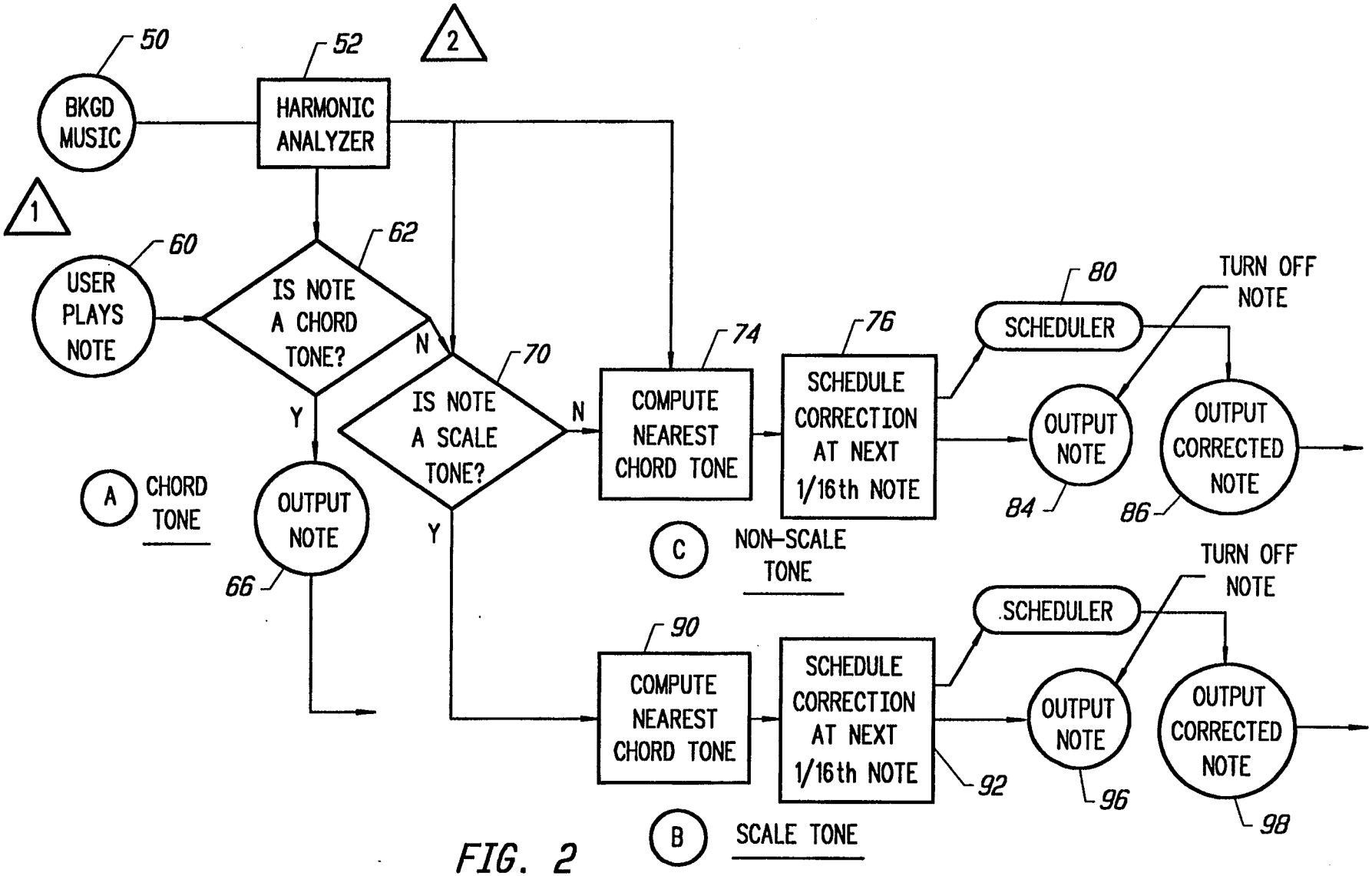
FIG. 2 depicts a flow chart illustrating the operation of the present invention.

FIG. 2 depicts a block diagram of the sequence of steps in conjunction with the dynamic correction of a musical instrument data stream according to the present invention.

In FIG. 2 there are two input sources, one of which is the background music (reference sequence) 50 and the other is a user playing a note 60 on the midi controller 12 of FIG. 1.

In FIG. 2, the background music 50 is input to a suitable harmonic analyzer 52. The present invention determines if the user playing a note (step 60) has played a chord tone (at step 62) together with a note that is in the chord of the background music from harmonic analyzer (step 52).

If the note is a chord tone (step 62), the instrument plays the note immediately (step 66). The user hears this note, which may be subject to further correction, as will be described below.

If the note is determined not to be a chord tone (at step 62), another decision is made to determine whether it is a scale tone (at step 70). If it is a scale tone, the note is played immediately and the user will hear it. Simultaneously, the present invention computes the nearest chord tone at step 90.

Next, the present invention schedules the scale tone to be corrected to a chord tone at step 92. This scheduling event is a dynamic event and is at some point in the future (step 92); a typical period could be an eighth note in the current tempo of the music. The musical effect heard is that the scale tone will be heard (step 96) and then in the near future the scale tone will be turned into a chord tone. This is accomplished by turning off the scale tone (step 94) and turning on the chord tone (step 98). The chord tone typically is the nearest chord tone to the existing scale tone.

Regarding the prior decisions, if the user plays a note that was not a scale tone (step 70), the flow is basically the same. The present invention computes the nearest chord tone (step 74) and immediately plays the non-scale tone, but at some point in the near future it is corrected into a chord tone (step 76). There is a separate branch in FIG. 2 in that interval (steps 80, 84, 86), because the period of time before the correction occurs is shorter than for a scale tone (on the order of a sixteenth note in the current tempo).

In FIG. 2, all notes that are sounding (played to the user) are corrected to a new and nearest chord tone when the harmonic context from harmonic analyzer 52 changes. The chord tone output is designated by path "A"; the scale tone output is designated by path "B"; and the non-scale tone output is designated by path "C".

FIGS. 3A–3D illustrate an example of the harmonic analysis of background music taken in conjunction when a user plays various tones on the midi controller instrument 12 of FIG. 1. FIG. 3A illustrates the reference analysis, FIG. 3B illustrates the user input and FIG. 3D illustrates the output. FIG. 3D illustrates the corresponding output "A" for chord tone; "B" for scale tone; and "C" for non-scale tone in the path for correction. The path "A" designator is the chord tone case, path "B" is the scale tone case, and path "C" is the nonscale tone case which corresponds to those same designators in FIG. 2.

The background music serves as a reference for the harmonic context, or the key in which the music is played. The key of "C", for example, comprises the chord tone of the notes C, E and G. The scale notes in the key of C are C, D, E, F, G, A and B (e.g., the white keys on a piano). The non-scale tone notes would be C♮, D♮, F♮, G♮ and In the present invention, when a note in the chord (C, E, or G) is played, the note played will be heard, unaltered.

If a note in the scale tone (D, F, A, B), the note played will be heard for a short duration, almost as a grace note, and then corrected, or "slipped" to the nearest chord tone note.

If a note not in the scale tone (C♮, D♮, F♮, G♮ and B♮) is played, the note played will be heard for a short duration, and then corrected or "slipped" to the nearest chord tone.

Example:

| Key | Note Played | Type of Note | Action Taken |
|---|---|---|---|
| C | C | chord tone | none |
| | C♯ | not scale tone | slipped to C |
| | D | scale note | slipped to C or E |
| | D♯ | not scale tone | slipped to E |
| | E | chord tone | none |
| | F | scale tone | slipped to E or G |
| | F♯ | not scale tone | slipped to G |
| | G | chord tone | none |
| | G♯ | not scale tone | slipped to G |
| | A | scale tone | slipped to G |
| | B | scale tone | slipped to C |
| | B♭ | not scale tone | slipped to C |

Timing of Corrections

The present invention requires a certain measure of time to correct or "slip" a note to the proper chord tone. This depends upon the timing of the background music. In common time, or 4/4 time, each measure requires four beats. Thus, a whole note counts as four beats, a half-note counts as 2 beats, a quarter note counts as 1 beat, an eighth note counts as a half a beat, and so on.

If the note played is in the chord tone, no correction is necessary. If the note played is in the scale tone, the preferred or desired delay is an 8th note in order to make the correction. For example, if a D (scale tone) is played as a whole note (4 counts), the listener would hear the D for an 8th note (or half a beat), and then would hear C or E for the other 3+ beats of the note.

If the note played is not in the scale tone, the correction procedure preferably utilizes a lesser period of time in order to make the correction. For example, if a C♮ (not scale tone) is played as a whole note (4 counts), the listener would hear the C♮ for a 16th note, almost as a grace note, and then would hear C for the other 3++ beats of the note.

The only exception to this generalization is when an 8th note scale tone is played. In this instance, since the preferred correction procedure generally utilizes an 8th note, the 8th note played would sound as played. If, however, the 8th note played is not a scale tone, the listener would hear the 8th note played for a 16th note period, and would then hear the corrected, or slipped note for a 16th note period.

Example:

| Timing 4/4 | Note Played | Slip Time In Scale | Slip Time Not In Scale |
|---|---|---|---|
| Four beats | Full note | 8th note | 16th note |
| Two beats | Half Note | 8th note | 16th note |
| One beat | Quarter note | 8th note | 16th note |
| One-half beat | Eighth note | no correction | 16th note |

Figure 3:
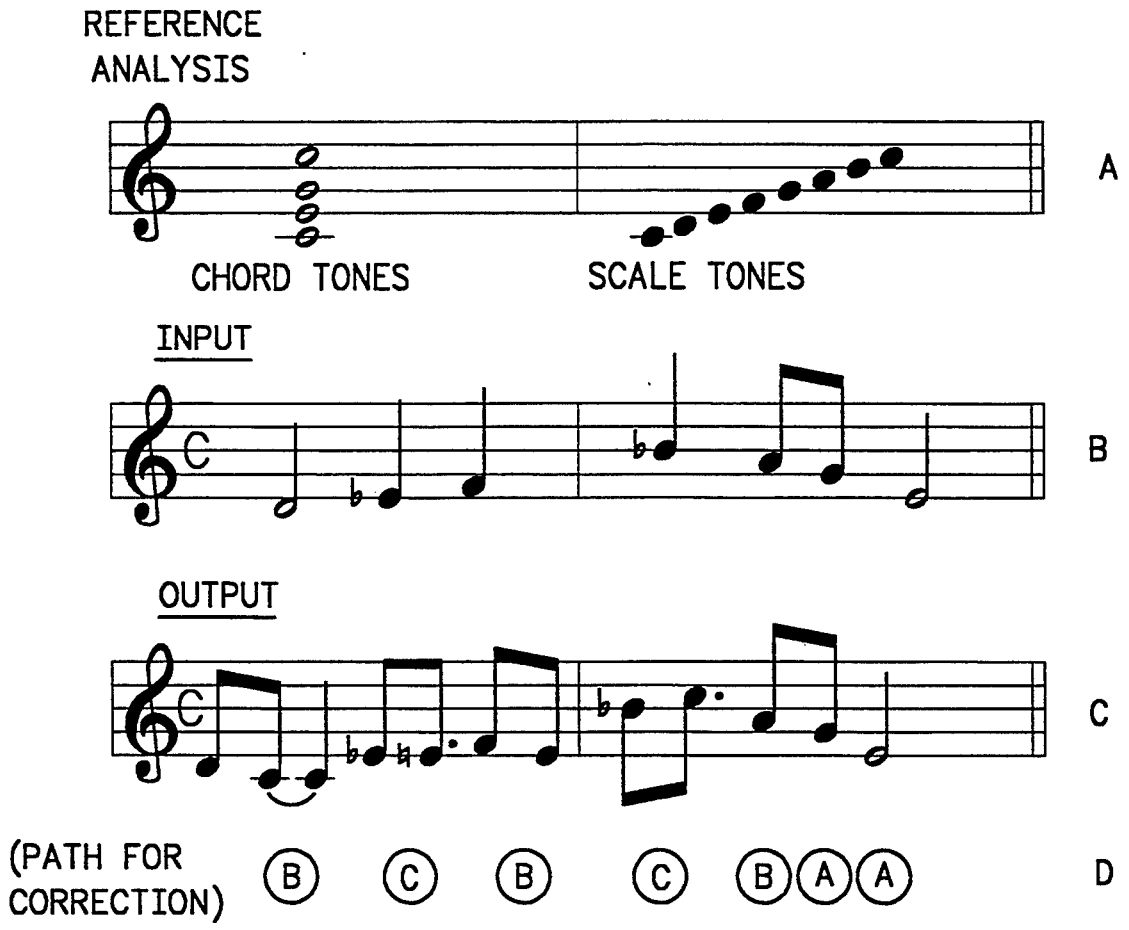
FIG. 3 depicts a diagram illustrating the dynamic correction of the present invention of FIGS. 1 and 2.

In the specific example of FIG. 3, there is a user input D for a half-note (two counts), E♮ for one count, F for one count, B♮ for one count, A and G (8th notes), and an E♮ (natural) half-note (two bar phrase).

The output (FIG. 3C) shows the D sliding down to a C after an 8th note and being held for this duration; the note is a scale tone; but not in the chord. For this specific example, in the period of an 8th note, the D would sound for an 8th note and then slides into C for the duration of the note, which is the nearest chord tone.

The next user input is an E♮, which is neither in the chord nor in the scale. After a 16th note, the E♮ is corrected up to an E♮, which is the nearest chord tone. The next user input note is an F for a quarter note. The F is in the scale but not in the chord, so after an 8th note it gets corrected to be an E.

B♮ is the next input note; it is not in the scale so after a 16th note it gets corrected to the nearest chord tone which is the adjacent C.

The next user input is A♮ for an 8th note. At is in the scale, but because the duration of the note is only an 8th note, by the time it would be corrected the input is gone. So the user hears what was played in that case. The next note is a G which is in the chord so it comes through unscathed, as does the final E♮.

According to another aspect of the present invention, a normalization feature is provided where for the background music, the key signature is known. If the key signature is not in the key of C, then the background music or the user input is transposed automatically to the key of C. This allows the user to have a keyboard where the user can clearly pick out different features of "slippery notes". For example, if the user just plays the white keys, the user knows he is always playing either chord tones or scale tones for something that is in the key of C or A minor. By hitting black keys, the user knows he is going to get discordant tones that will be corrected. By normalizing to the key of C and allowing the user to play on white or black keys, the user has an additional aspect of control over the generated music.

Additionally, all notes that are sounding, whether or not they have been corrected, change to be corrected to the new harmonic context when the harmonic context changes. For example, the user is holding some notes that may or may not have been corrected to a previously sounding background in the key of C. When that background changes to the key of F, all notes that are held would be corrected to chord tones in F.

A user playing the keyboard according to the present invention is able to easily pick out the melody (with a little practice) and hitting other keys produces automatic note correction to a pleasing resolving chord tone producing interesting harmonic variations (no wrong notes). A variable time delta to wait before correcting note allows a beginner instant correction and an advanced player the ability to "jam" without being corrected "too soon".

The present invention preserves the tonality of the keyboard (the user plays on a chromatic 12 tone keyboard).

A keyboard is transposed to match the music, which allows the user to learn scales based in C (i.e., keyboard is played in C, but output is transposed to key of the music–this defeats absolute pitch but enforces interval learning).

For keyboard correction, the user plays on a 12 tone scale keyboard (all the keys) with notes corrected as follows:

- User plays the melody note (no correction even if the melody note is in a different octave). The user expresses himself by holding the melody note (duration change), and the melody note is picked from the current melody channel using a variable melody anticipation time delta.
- User plays a harmonic tone (picked using a variable harmonic anticipation time delta). The note is corrected at the next harmony change.
- Scale tones are held a variable amount of time before being corrected to the closest harmonic tone using a variable harmony anticipation time.
- Chromatic tones are held a variable amount of time before being corrected to the closest harmonic tone using a variable harmony anticipation time.

A typical setup then is as follows:

- Chromatic tone hold time is equal to a grace note.
- Scale tone hold time is equal to a quarter note.
- All anticipation times are equal to a sixteenth note.

The user can play the melody in gated time by picking the proper melody key from the keyboard (these two requirements could frustrate the user–finding the proper key and playing in time with a gated melody). The user can express himself using key velocity, duration, repetition, the omission of melody notes, and the inclusion of other notes. Other notes play as expected if played fast, but resolve to a harmonic tone if held.

The foregoing descriptions of specific embodiments of the present invention have been presented for purposes of illustration and description. They are not intended to be exhaustive or to limit the invention to the precise forms disclosed, and it should be understood that many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. An electronic musical instrument comprising means for generating an input digital datastream representing a sequence of musical sounds, reference sequence means for providing reference sequence data representative of background harmonic musical sounds corresponding to said input datastream, control means for receiving said reference sequence data and said input datastream so as to provide dynamic correction to said datastream over a variable time delay, and sound generator means for providing dynamically corrected audio output sounds which are dynamically corrected over said variable time delay.

2. The instrument as in claim 1 including means for harmonically analyzing said reference sequence data and means for determining if the input datastream corresponds to a chord tone together with a note that is in the chord of the background music from the harmonic analyzer means.

3. The instrument as in claim 2 including means for playing the note immediately if the played note is a chord tone.

4. The instrument as in claim 2 including means for determining if the played note is a scale tone (if not a chord tone) and means for playing the scale tone immediately.

5. The instrument as in claim 4 including means for computing the nearest chord tone.

6. The instrument as in claim 5 including means for scheduling the scale tone to be corrected to a chord tone over a predetermined time delay.

7. The instrument as in claim 6 wherein the nearest chord tone corresponds to the existing scale tone.

* * * * *